US009039347B2

(12) United States Patent
Tadokoro et al.

(10) Patent No.: US 9,039,347 B2
(45) Date of Patent: May 26, 2015

(54) CROSS FLOW FAN, AIR BLOWER AND AIR CONDITIONER

(75) Inventors: Takahide Tadokoro, Chiyoda-ku (JP); Takashi Ikeda, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 586 days.

(21) Appl. No.: 13/497,287

(22) PCT Filed: Sep. 7, 2010

(86) PCT No.: PCT/JP2010/005476
§ 371 (c)(1),
(2), (4) Date: Mar. 21, 2012

(87) PCT Pub. No.: WO2011/036848
PCT Pub. Date: Mar. 31, 2011

(65) Prior Publication Data

US 2012/0263573 A1 Oct. 18, 2012

(30) Foreign Application Priority Data

Sep. 28, 2009 (JP) ..... 2009-222563

(51) Int. Cl.
*F04D 17/04* (2006.01)
*F04D 29/28* (2006.01)
*F04D 29/30* (2006.01)

(52) U.S. Cl.
CPC ..... *F04D 17/04* (2013.01); *F04D 29/283* (2013.01); *F04D 29/30* (2013.01)

(58) Field of Classification Search
CPC ..... F04D 17/04; F04D 29/283; F04D 29/30
USPC ..... 415/52.1, 53.1, 53.3; 416/178, 179, 416/182, 183, 184, 185, 186 R, 187
See application file for complete search history.

(56) References Cited

FOREIGN PATENT DOCUMENTS

| | | | | |
|---|---|---|---|---|
| JP | 8-1320 | * | 8/1996 | ..... F04D 29/30 |
| JP | 2594063 | B2 | 3/1997 | |
| JP | 3137897 | B2 | 2/2001 | |
| JP | 3777891 | B2 | 5/2006 | |
| JP | 2006-329099 | A | 12/2006 | |

OTHER PUBLICATIONS

International Search Report (PCT/ISA/210) issued on Dec. 14, 2010, by Japanese Patent Office as the International Searching Authority for International Application No. PCT/JP2010/005476.

* cited by examiner

*Primary Examiner* — Edward Look
*Assistant Examiner* — Juan G Flores
(74) *Attorney, Agent, or Firm* — Buchanan Ingersoll & Rooney PC

(57) ABSTRACT

Disclosed is a cross flow fan that makes uniform a distribution of wind velocity along an axial direction of the fan at an exit of an air trunk and that lessens chance of separation of an air flow on an inlet side of the fan, and there are thereby provided a cross flow fan that accomplishes a lower input and smaller noise and an air blower and an air conditioner that use the cross flow fan. A cross flow fan being rotatably placed in a horizontally-long air trunk, and including a plurality of annular rings that are substantially parallel to each other and a plurality of blades that are radially interposed between adjacent rings, each having a circular arc cross sectional shape, and a camber angle of the blade is smaller at the ring side than at a center area of the blade between the rings in a longitudinal direction.

7 Claims, 7 Drawing Sheets

(a) RING PORTION (b) BLADE PORTION (a) WHEEL END PORTION (b) WHEEL CENTER PORTION (A)

(A)

(a) LINE OF SIGHT FOR OBSERVATION (b) FLOW IN AIR TRUNK (c) SCHEMATIC DIAGRAM SHOWING GROWTH OF VORTEX

CROSS FLOW FAN, AIR BLOWER AND AIR CONDITIONER

TECHNICAL FIELD

The present invention relates to a cross flow fan used in an indoor unit of an air conditioner and an air blower and an air conditioner using the cross flow fan.

BACKGROUND ART

There is recently an increasing number of models of air blowers and air conditioners having housings with a large width (along an axial direction of a fan) so as to cover a large room. Correspondingly, a length of a shaft of a cross flow fan employed in the air conditioner is also increasing. Accordingly, an intensive three dimensional flow is generated in an axial direction of the fan, and the flow increasingly contributes to blasting performance such as power consumed by the fan and noise of the fan.

As a related art technique intended for lowering an input and reducing the noise of an air blower using a cross flow fan, there is an example in which a current plate is mounted on a wall surface of the air blower to make wind velocity distribution uniform (see; for example, Patent Document 1). Further, there is an air conditioner in which an outer diameter of a blade of a cross flow fan is changed such that the outer diameter of the blade takes the maximum value between rings of the cross flow fan in order to increase the volume of air while inhibiting generation of blade noise (see; for example, Patent Document 2). Further, there is a cross flow fan in which a blade entrance angle is smaller closer at an edge side of a divider plate than at a blade center in order to reduce noise by inhibiting generation of noise caused by turbulence (see; for example, Patent Document 3).

RELATED ART DOCUMENT

Patent Document

Patent Document 1: Japanese Patent No. 2594063 (page 3, FIG. 2)
Patent Document 2: Japanese Patent No. 3777891 (page 5, FIG. 1)
Patent Document 3: JP-A-2006-329099 (page 7, FIG. 1)

DISCLOSURE OF THE INVENTION

Problem that the Invention is to Solve

A cross flow fan is generally configured of blades and rings disposed at both ends of the blades to support the blades. In order to assure strength, an outer diameter of a ring part is greater than an outer diameter of a blade part. As a matter of course, a distance between the cross flow fan and a member configuring an air trunk becomes smaller at the ring part. Therefore, a smaller gap is generated between the ring part of the cross flow fan and the air trunk. Accordingly, among the air flowed into the cross flow fan by way of an entrance of the air trunk, air that passes through the ring part passes through a smaller gap, so that the air passes through the cross flow fan as a high speed flow.

FIG. 7 is a schematic view showing a flow of a blow course of an air blower equipped with the related art cross flow fan. As indicated by an arrow shown in FIG. 7(*a*), a gap generated between a cross flow fan 1 and a rear guide 13, which is a member configuring the air trunk, is observed from a position above an air conditioner. FIG. 7(*b*) is a view schematically showing the flow generated at this time. Since the gap becomes narrow at the ring part, a fast flow 19*a* develops. In the meantime, since the gap becomes wide at the blade part, a slow flow 19*b* develops. When a velocity difference occurs in a widthwise direction as mentioned above, a second flow that is a mixture of the fast flow 19*a* and the slow flow 19*b* develops. Thus, a vortex 20 whose axis is oriented along a direction of the blow course grows. As shown in FIG. 7(*c*), the vortex extends to a downstream of the air trunk, to thus become gradually greater and hinder an air flow at a blow outlet. Thus, variations in velocity distribution 21 achieved in a widthwise direction at the blow outlet become noticeable.

FIG. 8 is a view showing a simulation result of velocity of a blow course of the related art air blower. An upper drawing of FIG. 8 is a front view of an air conditioner, and numbers 1 through 20 depicting points of observation are provided at a position below the cross flow fan configured by the rings 2 and the blades 3. A lower drawing of FIG. 8 is a graph showing an average wind velocity achieved at each of the points of observation. When viewed together with the upper drawing of FIG. 8, it can be seen that the average wind velocity assumes a local maximum value near each of the rings 2. When a local high speed flow collides against blades for controlling a direction of wind at the blow outlet, a pressure loss contributing a square of wind velocity becomes greater. Further, variations in pressure exerted on surfaces of the blades for adjusting the direction of the wind also become greater, whereby a noise value also becomes greater.

On the contrary, when a current plate is placed in the air trunk as described in Patent Document 1, a new high speed area is generated in narrow gaps between the current plate and the blades. Thus, there is a problem that it is difficult to prevent occurrence of a vortex and a wind velocity distribution along the axial direction of the fan at an exit of the air trunk becomes difficult to be uniform.

According to the technique disclosed Patent Document 2, gap between the blades and the air trunk member becomes narrow in an area where a blade chord length is long and where an outer diameter of the fan is large, and the flow of the blow also becomes faster in the area. For these reasons, there is a problem that abnormal sound stemming from the air trunk member increases. Moreover, a contact may occur between the blades and the air trunk member due to a manufacturing error, or the like.

According to the technique described in Patent Document 3, external angles of the respective blades are changed. Therefore, there is a problem that noise may be caused due to airflow separation on an inlet side of the cross flow fan.

In all of the above-described Patent Documents, the wind velocity caused by the cross flow fan is taken into account. However, no consideration is given to variations in wind velocity of an air flow passing through the gap between the cross flow fan and the air trunk member. Thus, the distribution of wind velocity along the axial direction of the fan at the exit of the air trunk becomes non-uniform, which in turn poses a problem of an increase in input and noise of the air blower and the air conditioner.

The present invention has been conceived to solve the above-described problems and the object of the thereof is to provide a cross flow fan that makes uniform the distribution of wind velocity along an axial direction of a fan at an exit of an air trunk, in consideration of variations in wind velocity of a air flow passing through gap between the cross flow fan and the air trunk member, and that realizes reduced separation of the airflow at an inlet side of the fan, thereby providing a cross flow fan that realizes reduced input and noise and an air blower or an air conditioner using the cross flow fan.

Means for Solving the Problem

A cross flow fan of the present invention is rotatably placed in a horizontally-long air trunk, and the cross flow fan includes a plurality of annular rings that are substantially parallel to each other, and a plurality of blades that are radially interposed between adjacent rings, each having a circular arc cross sectional shape, and a camber angle of the blade is smaller at the ring side than at a center area of the blade between the rings in a longitudinal direction.

Advantage of the Invention

The present invention makes it possible to make a distribution of wind velocity along a longitudinal direction of a fan at an exit of an air trunk uniform in consideration of variations in wind velocity of an air flow passing through gap between the cross flow fan and an air trunk member. There can be acquired a cross flow fan that realizes a reduced input and smaller noise and an air blower or an air conditioner using the cross flow fan.

DESCRIPTIONS OF THE REFERENCE NUMERALS AND SYMBOLS

1 CROSS FLOW FAN
2 RING
3 BLADE
4 SINGLE IMPELLER
5 OUTER DIAMETER OF RING
6 CENTER LINE OF BLADE
7 CAMBER ANGLE
8 HEAT EXCHANGER
9 AIR PURIFIER
10 FILTER
11 NOZZLE
12 STABILIZER
13 REAR GUIDE
14 ROTATIONAL DIRECTION
15 AIR FLOW PASSING THROUGH AIR CONDITIONER
16 VANE
17 BLOW OUTLET
19 AIR FLOW
20 VORTEX
21 DISTRIBUTION OF WIND VELOCITY OF BLOW OUTLET
22 AIR FLOW ACHIEVED IMMEDIATELY AFTER HAVING PASSED THROUGH FAN
23 BLADE CHORD LENGTH
24 CIRCULAR ARC OF OUTER DIAMETER OF BLADE
25 POINT OF INTERSECTION
26 EXIT ANGLE
30 SUCTION OPENING

BEST MODES FOR IMPLEMENTING THE INVENTION

First Embodiment

Figure 1:
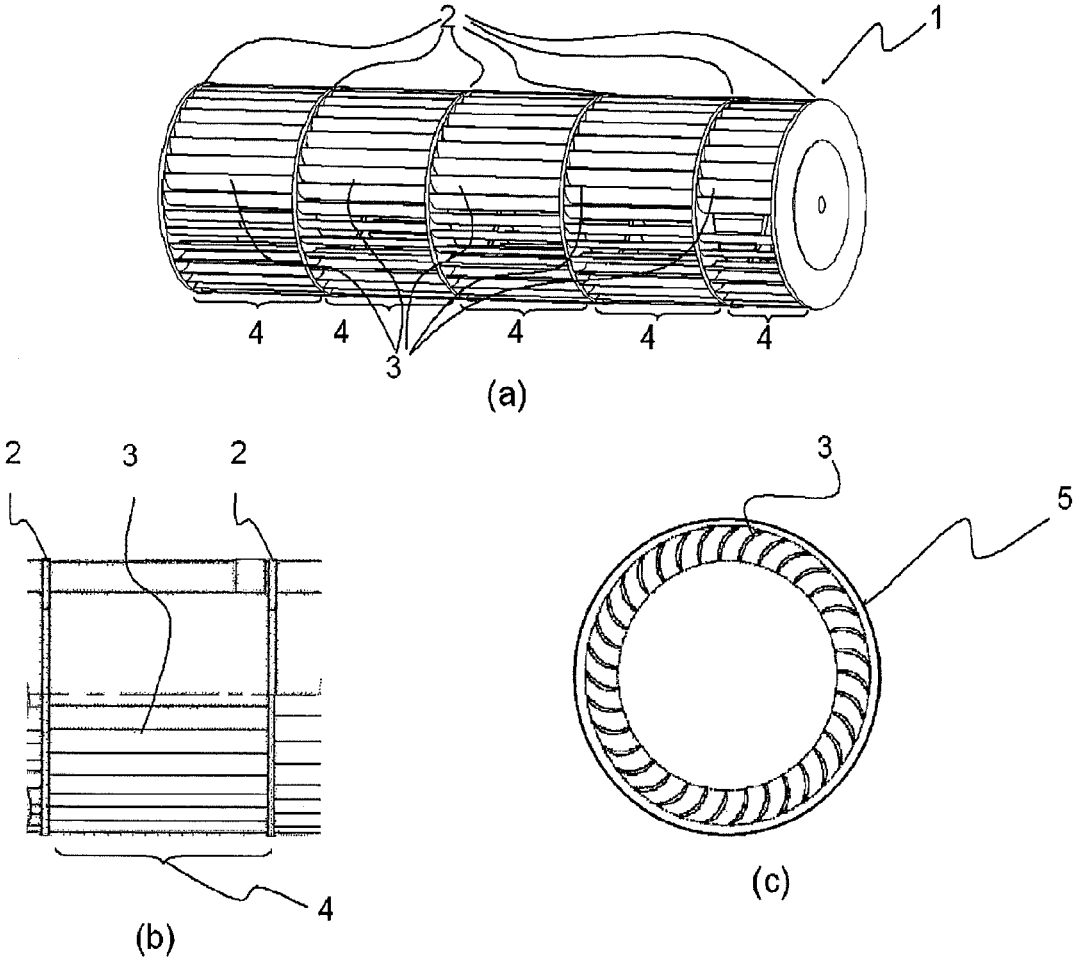
FIG. 1 shows a cross flow fan of a first embodiment of the present invention, wherein (a) is an oblique perspective view showing appearance of the cross flow fan, wherein (b) is a front view of a main section of the cross flow fan, and wherein (c) is a longitudinal cross sectional view of the cross flow fan.

FIG. 1(*a*) is an oblique perspective view showing an appearance of a cross flow fan 1 of a first embodiment of the present invention. A plurality of blades 3, each of which is at both ends thereof supported by rings 2, are provided along a circumferential direction of the rings 2. Some single impellers 4 (hereinafter called a "single wheel"), each of which is made up of the rings 2 and the blades 3, are joined together along an axial direction of a fan, to thus configure the cross flow fan 1. FIG. 1(*b*) is a front view of a main section of the single impeller 4. As shown in FIG. 1(*b*), an outer diameter defined by outer edges of the blades 3 is constant along the axial direction of the cross flow fan 1. FIG. 1(*c*) shows a longitudinal cross sectional view of the impeller of the single wheel. A ring outer diameter 5 is larger than the outer diameter of the blades 3, and the blades 3 are radially, fixedly bonded to the ring 2 at an inside with reference to an outer circumference of the ring 2. Further, each of the blades 3 is formed in a circular-arc cross sectional shape.

Figure 2:
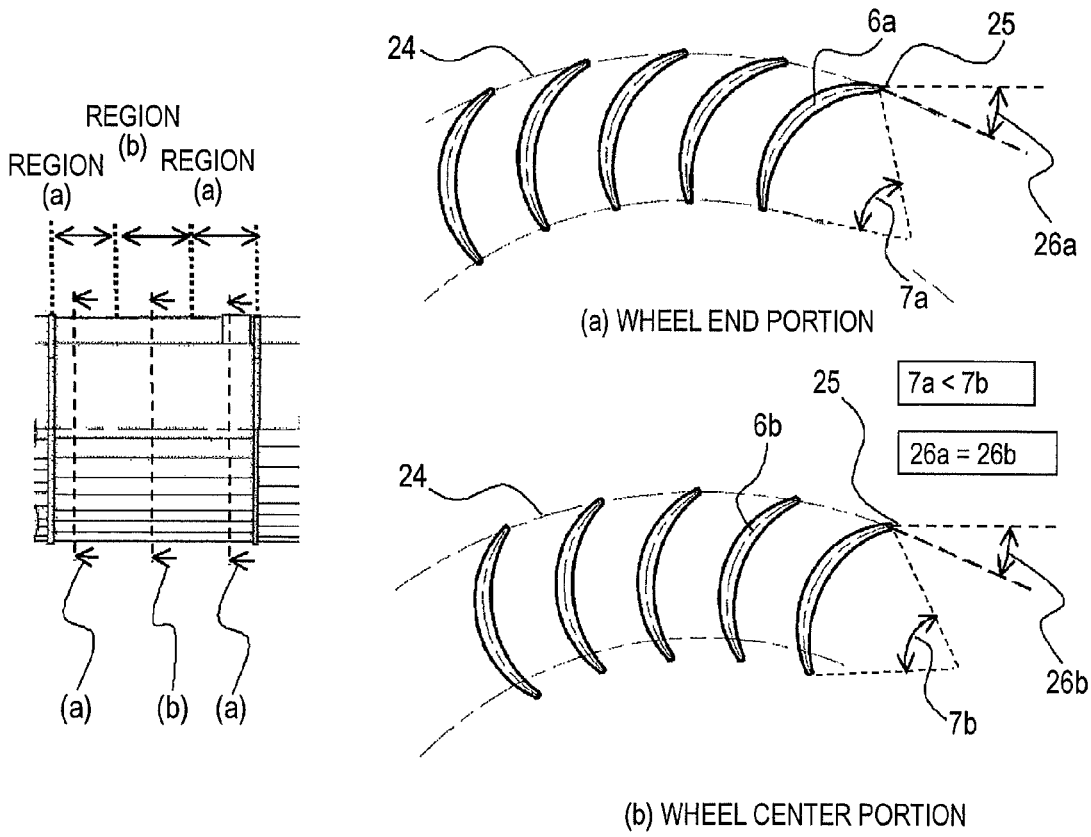
FIG. 2 is a longitudinal cross sectional view of the cross flow fan of the first embodiment, wherein (a) is a longitudinal cross sectional view of a wheel end portion and wherein (b) is a longitudinal cross sectional view of a wheel center portion.

FIG. 2 is a longitudinal cross sectional view of the cross flow fan 1 of the first embodiment. The blades 3 of the impeller of the single wheel, which are sandwiched between the rings, are divided into three regions (a), (b), and (a) from the left, and the cross sectional shape of the blade differs in each region. A division ratio of the region (a) is set to about one-third to less than one-half of a length of the single wheel. The regions (a) of the blades 3 close to the respective rings 2 are hereinafter called "wheel end portions," whilst the region (b) of the blade center is hereinafter called a "wheel center portion."

FIG. 2(*a*) is a longitudinal cross sectional view of the wheel end portion, and FIG. 2(*b*) is a longitudinal cross sectional view of the wheel center portion. A center of a thickness of each blade, from a blade leading end that configures an outer periphery of the blade 3 to a rear end that configures an inner periphery of the blade 3, is defined as a blade center line. The blade center line of the wheel end portion is assigned reference numeral 6*a*, and the blade center line of the wheel center portion is assigned reference numeral 6*b*. Angles that the blade leading ends of the blade center lines 6*a*, 6*b* form with the rear ends of the blade center lines 6*a*, 6*b* are respectively defined as camber angles 7*a*, 7*b*. The amber angle 7*b* of the wheel center portion is made larger than the camber angle 7*a* of the wheel end portion (7*a*<7*b*).

Moreover, in relation to the cross section of each of the blades, an exit angle 26*a* (or 26*b*), which is achieved at a point of intersection 25 where the blade center line 6*a* (or 6*b*) and a circular arc 24 of the blade outer diameter cross each other, is uniform at both the wheel center portion and the wheel end portion (26*a*=26*b*). The exit angle means an angle that a tangential line of the blade center line 6*a* (or 6*b*) and a tangential line of the circular arc 24 along the outer diameter of the blades form at the point of intersection 25.

In order to make the camber angle 7*b* of the wheel center portion large, the blade center line 6*b* can be extended toward the inner circumference of the blade 3. As an alternative, a blade chord length, which will be described later, can be extended toward the inner circumference on condition that the exit angle 26*b* remains unchanged.

Figure 3:
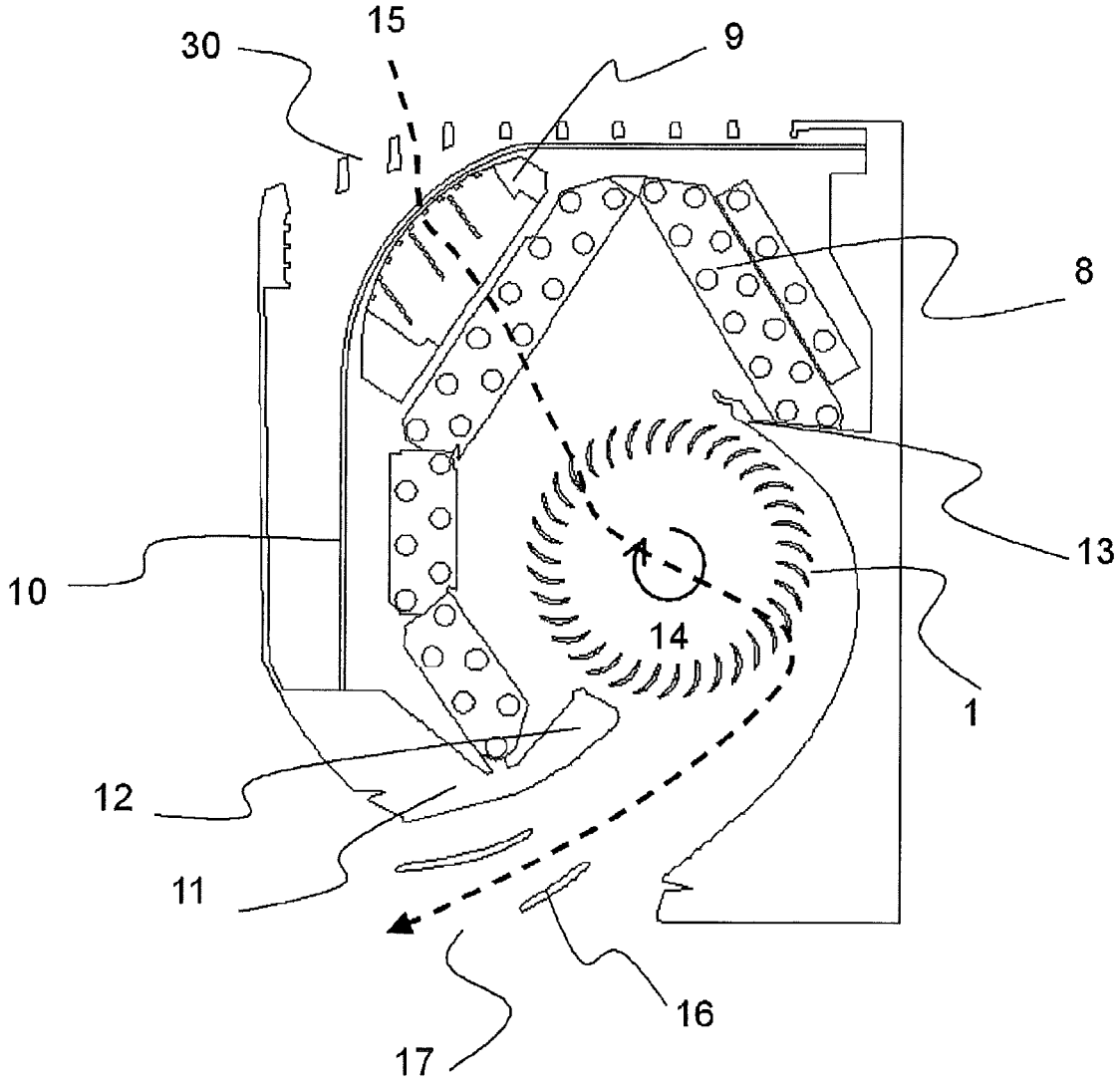
FIG. 3 is a longitudinal cross sectional view of an air conditioner using the cross flow fan of the first embodiment.

FIG. 3 is a longitudinal cross sectional view of an air conditioner using the cross flow fan 1. A heat exchanger 8 that exchanges heat between air and a coolant is disposed so as to enclose surroundings of the cross flow fan 1. A suction opening 30 are formed in an upper surface of the air conditioner. An air purifier 9 and a filter 10 are interposed between the suction opening 30 and the heat exchanger 8.

An inlet side and an outlet side of the cross flow fan 1 are partitioned by a stabilizer 12 attached to an extremity of a nozzle 11 located on a front side of the unit and a rear guide 13 located on a rear side of the unit. Thereby, an air trunk extending from the suction opening 30 to the blow outlet 17 is divided into two. The blow outlet 17 is provided with a vane 16 for adjusting a wind direction.

Next, operation of the cross flow fan will be described.

In FIG. 3, when the cross flow fan 1 rotates in a direction designated by reference numeral 14, an air flow 15 that entered the suction opening 30 of an air blower passes through the cross flow fan 1, to thus exit from the blow outlet 17.

Figure 4:
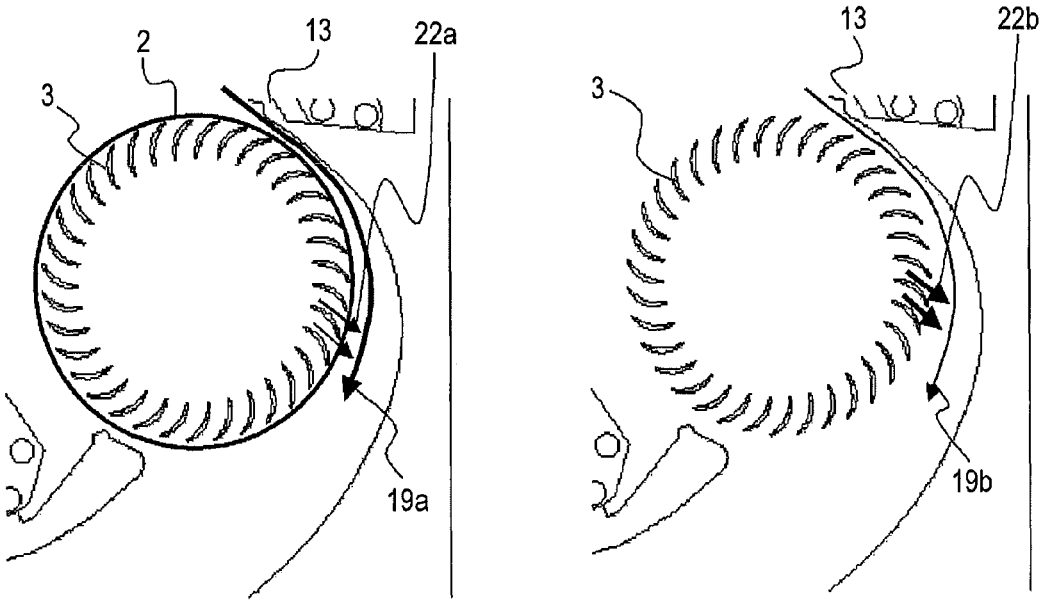
FIG. 4 is a longitudinal cross sectional view of a main section of the air conditioner using the cross flow fan of the first embodiment, wherein (a) is a longitudinal cross sectional view of a main section of a ring, and wherein (b) is a longitudinal cross sectional view of a main section of blades.

FIG. 4 is a longitudinal cross sectional view of a main section of the air conditioner using the cross flow fan of the first embodiment. A gap between the rings 2 and the rear guide 13 is narrower than a gap between the blades 3 and the rear guide 13. An air flow 19*a* passed near the rings becomes faster than an air flow 19*b* passed near the blades. However, the camber angle of each of the blades 3 achieved at the wheel center portion becomes larger than the camber angle of each of the blades 3 achieved at the wheel end portion. Hence, workload imparted to the airflow by the blades 3 at the wheel center portion is larger than workload imparted to the airflow by the blades 3 at the wheel end portion. For these reasons, an air flow 22*b* exiting out of the wheel center portion becomes faster than an air flow 22*a* exiting out of the wheel end portion.

Accordingly, a speed of the faster air flow 19*a* passed through the gap in the vicinity of the rings is increased by the slower air flow 22*a*. On the contrary, a speed of the slower air flow 19*b* passed near the blades is increased by the faster air flow 22*b*. However, since the slower air flow 19*b* passed near the blades is increased speed by the faster air flow 22*b*, a difference between the wind velocity of the air flow 19*a* and the wind velocity of the air flow 19*b* achieved at a downstream of the fan can be reduced.

As mentioned above, the workload imparted by the blades to the air flow passed through the gap between the cross flow fan 1 and the rear guide 13 is changed, whereby the difference between the wind velocity of the air flow from the wheel end portion at the downstream of the fan and the wind velocity of the air flow from wheel center portion at the downstream of the fan becomes smaller, and hence occurrence of a vortex, which would otherwise be caused by a difference in wind velocity, can be prevented. Thus, the distribution of wind achieved at downstream of the fan is made uniform. The air flow having a uniform distribution of wind velocity at the downstream of the fan is let outside the unit by way of the blow outlet 17 along the direction defined by the vane 16 for controlling an air flow.

In the meantime, as shown in FIG. 2, the exit angle 26*a* (or 26*b*) of the wheel center portion and that of the wheel end portion are equal (26*a*=26*b*). If the exit angle varies, air flow separation may arise in any of the blades along the widthwise direction, which may further increase noise. However, in the first embodiment, the exit angles 26 are made uniform, so that an inflow state of air to extremities of the respective blades is made uniform. As a consequence, a distribution of wind velocity achieved in an air blow trunk can be made uniform without deteriorating noise, which would otherwise be caused when inflow air is separated by a row of blades.

Table 1 shows results of comparative tests conducted by use of an air conditioner using a related art cross flow fan and the air conditioner of the first embodiment. Table 1 shows differences in fan power and noise. As illustrated in Table 1, it turns out that both power and noise are lessened and improved by use of the cross flow fan of the first embodiment.

TABLE 1

| Air Volume ($m^3$/min) | Differences in Fan Power (W) | Differences in Noise (dB) |
|---|---|---|
| 8 | −0.36 | 0.23 |
| 10 | −0.57 | 0.09 |
| 12 | −0.80 | −0.03 |
| 14 | −1.08 | −0.13 |
| 16 | −1.48 | −0.22 |
| 18 | −2.01 | −0.30 |
| 20 | −2.74 | −0.38 |

According to the first embodiment, an outer diameter of each of the blades 3 is made constant. A distribution of velocity that is caused, in the air blower and the air conditioner, by differences in gap between the cross flow fan 1 and the rear guide 13 is canceled by the distribution of wind velocity of a blow of the cross flow fan. Therefore, a vortex that acts as resistance to the air flow disappears, and the distribution of wind velocity achieved at the exit of the air trunk can be made uniform. As a result of the exit angles being made uniform, there can be realized a cross flow fan that is free from hindrance to passage of an air flow among blades and separation of the air flow.

Since the distribution of wind velocity achieved at the exit of the air trunk is made uniform, a local high-speed flow disappears. Further, the velocity of the air flow passing through the vane 16 for air flow control is made uniform, thereby yielding an advantage of a reduction in pressure loss and fan input. Pressure variations on the surface of the vane 16 and the air trunk are lessened, which also yields an advantage of noise reduction.

Second Embodiment

In the first embodiment, an increase or decrease in the volume of air blow is changed by camber of the blades. However, the volume of air can also be changed by the blade chord length.

Figure 5:
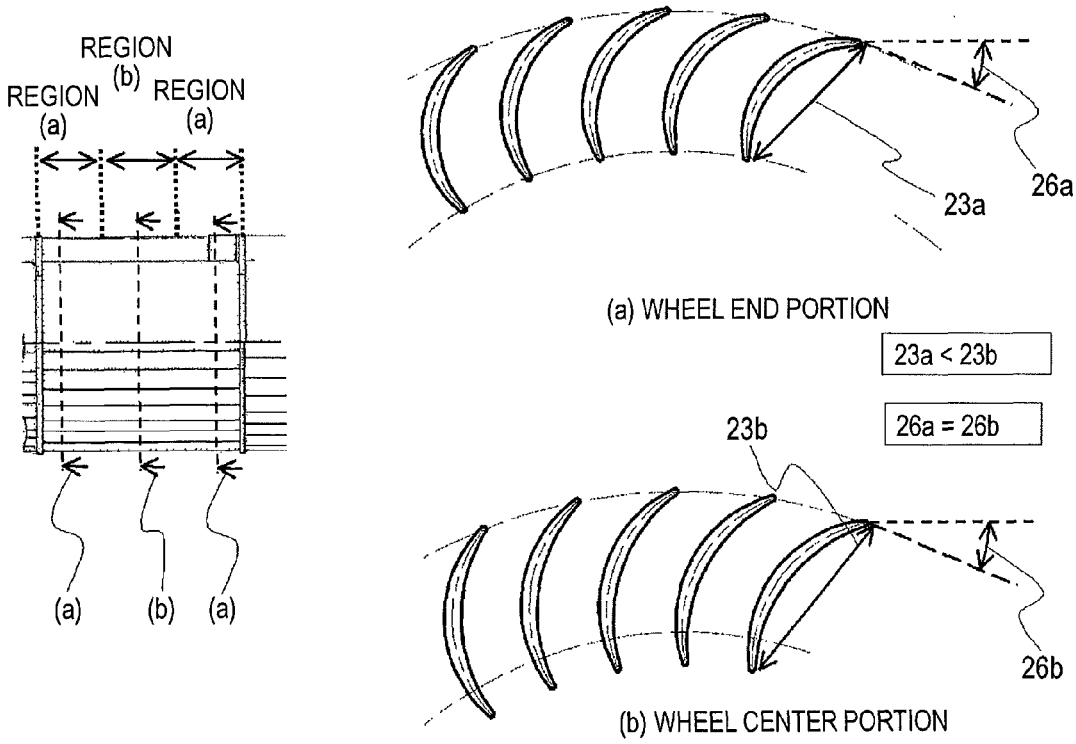
FIG. 5 is a longitudinal cross sectional view of a cross flow fan of a second embodiment of the present invention, wherein (a) is a longitudinal cross sectional view of a wheel end portion and wherein (b) is a longitudinal cross sectional view of a wheel center portion.

FIG. 5 is a longitudinal cross sectional view of the cross flow fan 1 of a second embodiment. The cross section of the impeller for one wheel is illustrated while separated into the wheel end portion (a) and the wheel center portion (b) as in the first embodiment. When attention is paid to the cross section of the blade, a straight line (a blade chord length 23) from the extremity of the blade to the rear end of the blade is characterized in that a blade chord length 23*b* of the wheel center portion is longer than a blade chord length 23*a* of the wheel end portion (23*a*<23*b*).

As in the first embodiment, when viewed in the cross section of the blade, the exit angle 26*a* (or 26*b*), which is formed at the point of intersection 25 where the blade center line 6*a* (or 6*b*) crosses the circular arc 24 of the outer diameter of the blade, becomes uniform at the wheel center portion and near the rings (26*a*=26*b*).

Since the blade chord length becomes longer, the workload imposed on the air flow by the blades is increased, so that the velocity of the air flow achieved after the air flow has passed among the blades increases. In the meantime, the workload imposed on the air flow by the portion of the blade having a short chord length is small. Hence, the velocity of the air flow achieved after the air flow has passed among the blades is slower than the velocity of the air flow achieved at the longer chord length. For these reasons, the distribution of wind velocity caused by differences in gap of the air trunk is lessened, so that the vortex in the air trunk disappears in the same manner as in the first embodiment. As a result, there can be realized an air blower or an air conditioner in which the distribution of wind velocity achieved at the exit of the air trunk is made uniform, to thereby achieve a smaller pressure loss caused by the vane, an smaller input, and lower noise.

In the second embodiment, the outer diameter of each of the blades 3 is made uniform, and the distribution of velocity caused by differences in gap between the fan and the air trunk developing in the air blower or the air conditioner is canceled by the distribution of velocity of the blow of the cross flow fan, as in the first embodiment. Hence, there is yielded an advantage of disappearance of a vortex, which would otherwise cause a resistance to the air flow, and the ability to make the distribution of wind velocity achieved at the exit of the wind trunk uniform.

The direction of an outer circumference edge of the blades is made uniform with respect to the direction of the air flow achieved on the inlet side. This yields an advantage of the ability to realize a cross flow fan that prevents hindrance to passage of an air flow among blades and air flow separation. Even in an air blower and an air conditioner that yield large differences in wind velocity of a blow from the fan, the distribution of wind velocity achieved at the exit of air trunk is made uniform. There is yielded an advantage of accomplishment of a smaller pressure loss caused by a vane, a smaller input, and lower noise.

In the first and second embodiments, the type of a parameter of blade shape is changed one at a time. However, when the differences in wind velocity occurred in the wind trunk are large, the velocity distribution of fan blow must be intensified. In that case, there may also be adopted a blade shape that is a combination of parameters, like the blade chord length and camber.

By a combination of a plurality of parameters, differences in wind velocity that are larger than those caused by adjustment of one parameter can be achieved. Therefore, even in a related art air blower or air conditioner that produces an intensified distribution of wind velocity at the exit of the air trunk, there is yielded an advantage of the ability to realize an air blower or an air conditioner that has a smaller input as a result of a distribution of wind velocity achieved at the exit of the air trunk being made uniform, thereby lessening noise.

Third Embodiment

The embodiments that have been described thus far are the cases in which each of the blades belonging to a single wheel of the impellers changes in shape along its widthwise direction. When the shape of the blade is changed along its widthwise direction, a step appears in the surface of the blade when the shape is sharply changed. The step may induce a vortex on the surface of the blade or increase pressure fluctuations, which may in turn deteriorate noise.

Figure 6:
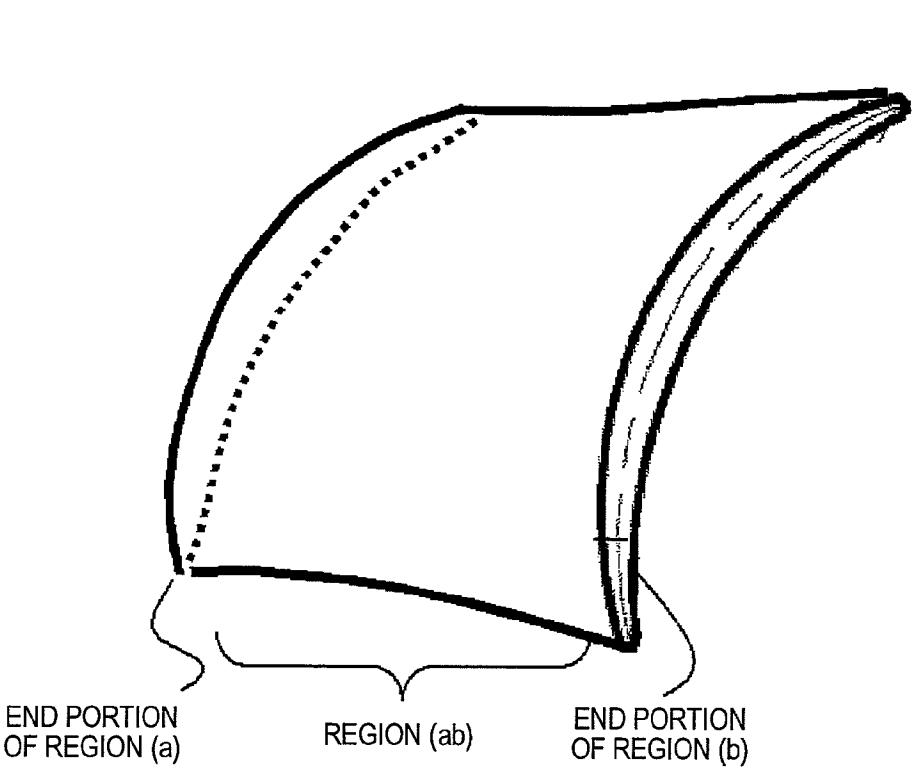
FIG. 6 is a view showing a cross flow fan of a third embodiment, wherein (a) is a front view of the cross flow fan and wherein (b) is an oblique perspective view of the same.
Figure 6:
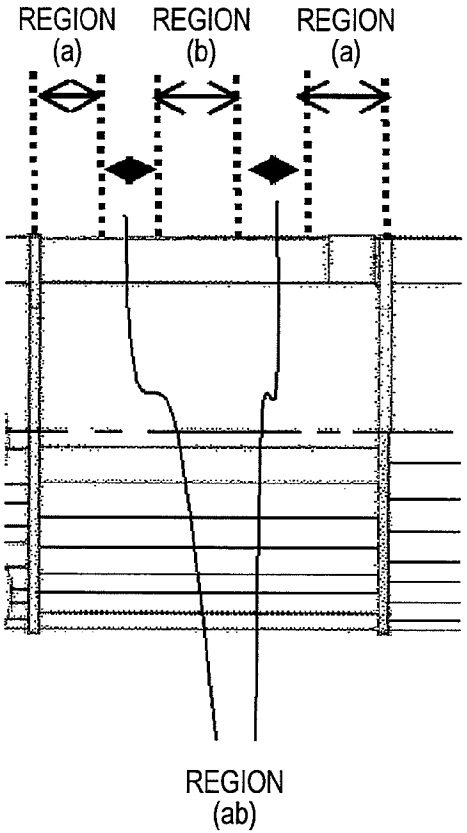
Figure 7:
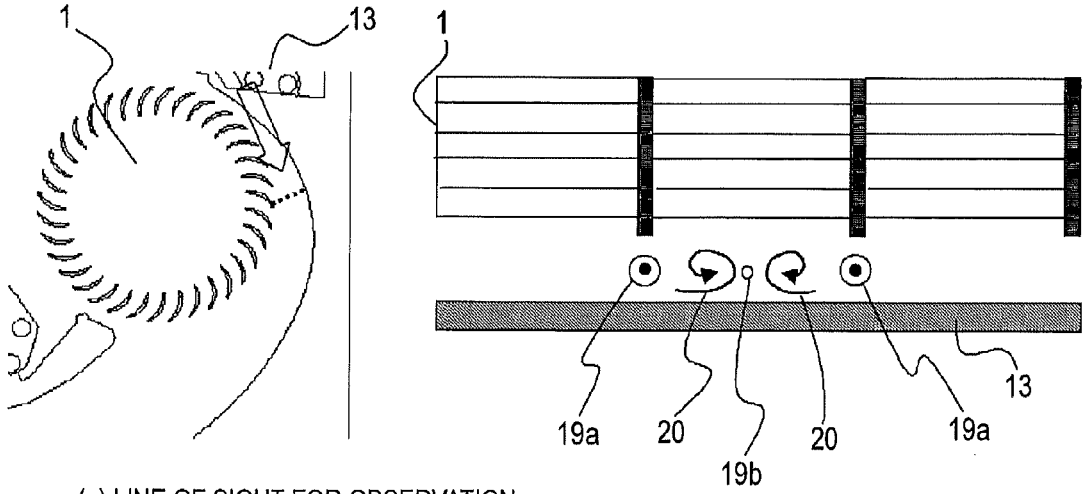
FIG. 7 is a schematic view for explaining a related art, wherein (a) is a view showing a line of sight for observation, wherein (b) is a view showing a flow in an air trunk, and (c) is a schematic view showing growth of a vortex.
Figure 7:
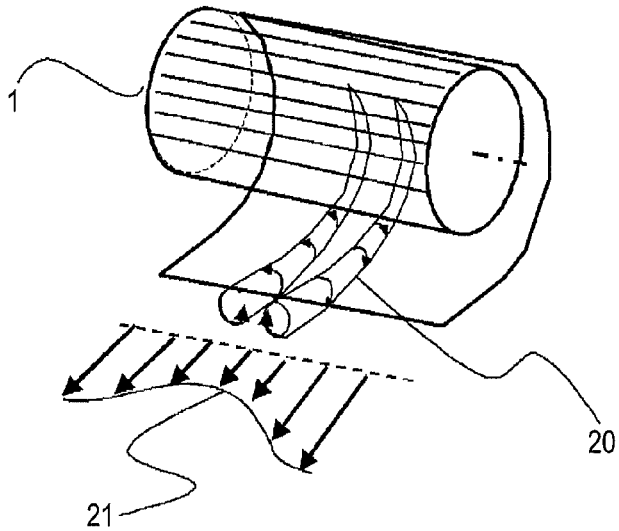
Figure 8:
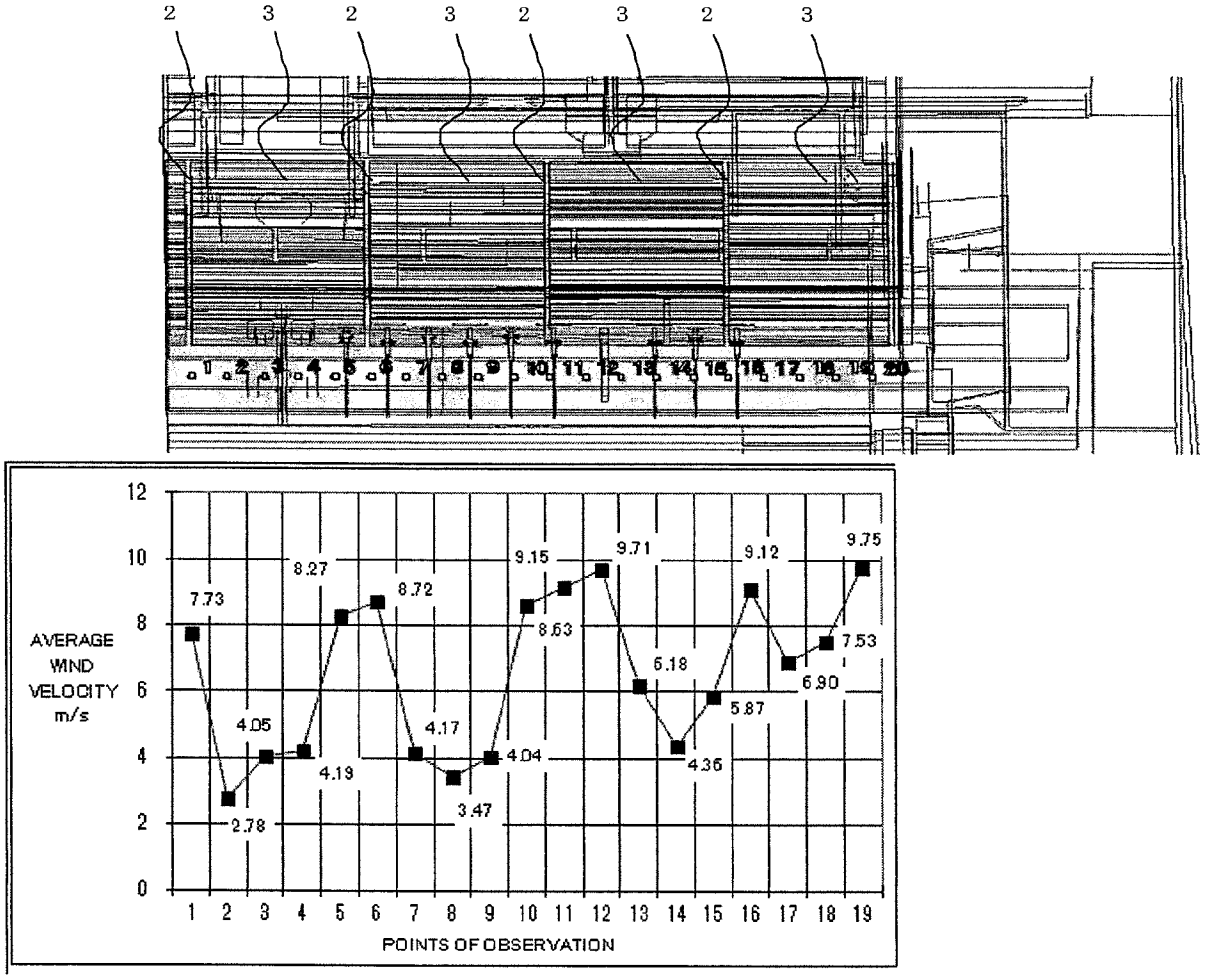
FIG. 8 is a view showing a result of simulation of wind velocity of a blow air trunk of a related art air blower.

FIG. 6(A) is a front view of a cross flow fan of the third embodiment, and FIG. 6(B) is an oblique perspective view of the cross flow fan of a region (ab) shown in FIG. 6(A). In the third embodiment, the region (ab), which is a continuous inclined surface, is provided between the region (a) and the region (b) of the impeller. The shape of the blade is smoothly changed so that a step will not arise on the surface of the blade between the region (a) and the region (b).

According to the third embodiment, the step is absent from the surface of the blade, which yields an advantage of prevention of occurrence of a vortex at the surface and development of noise caused by pressure fluctuations. Moreover, when an air blower or an air conditioner is equipped with the cross flow fan, the distribution of wind velocity achieved at downstream of the fan is made uniform while influence of the changes in shape of the blades is suppressed, whereby there is yielded an advantage of the ability to implement an air blower and an air conditioner that realizes a smaller input and reduced noise.

INDUSTRIAL APPLICABILITY

The present invention yields a similar advantage even when applied to another equipment using the cross flow fan, like an air purification apparatus or a dehumidification apparatus.

The invention claimed is:

1. A cross flow fan that is rotatably placed in a horizontally-long air trunk, the cross flow fan comprising:

a plurality of annular rings that are substantially parallel to each other, and a plurality of blades that are radially interposed between adjacent rings, each having a circular arc cross sectional shape, wherein an outer diameter and an exit angle of the blades are constant between the adjacent rings, wherein a shape of each blade at a ring side and a shape of each blade at a center area of the blade differs from each other such that, when the blades rotate, a speed of an air flow that passes a gap in the vicinity of the ring and a speed of an air flow that passes the center area of the blade become substantially uniform, and wherein a chord length of each blade is shorter at the ring side than at the center area of the blade.

2. The cross flow fan according to claim 1, wherein a surface of each blade is formed of a continuous inclined surface.

3. An air blower or an air conditioner having the cross flow fan according to claim 1.

4. The cross flow fan according to claim 1, wherein a camber angle of each blade is smaller at the ring side than at the center area of the blade.

5. A cross flow fan that is rotatably placed in a horizontally-long air trunk, the cross flow fan comprising:

a plurality of annular rings that are substantially parallel to each other, and a plurality of blades that are radially interposed between adjacent rings, each having a circular arc cross sectional shape, wherein an outer diameter and an exit angle of the blades are constant between the adjacent rings, wherein a shape of each blade at a ring side and a shape of each blade at a center area of the blade differs from each other such that, when the blades rotate, a speed of an air flow that passes a gap in the vicinity of the ring and a speed of an air flow that passes the center area of the blade become substantially uniform, and wherein a camber angle of each blade is smaller at the ring side than at the center area of the blade.

6. The cross flow fan according to claim 5, wherein a surface of each blade is formed of a continuous inclined surface.

7. An air blower or an air conditioner having the cross flow fan according to claim 5.

* * * * *